US006135878A

United States Patent [19]

Felsen

[11] Patent Number: 6,135,878

[45] Date of Patent: Oct. 24, 2000

[54] MODULAR CORE AIR DIFFUSERS

[75] Inventor: Karl H. Felsen, Winnipeg, Canada

[73] Assignee: E. H. Price Limited, Winnipeg, Canada

[21] Appl. No.: 09/257,865

[22] Filed: Feb. 26, 1999

[51] Int. Cl.[7] ..... F24F 13/068

[52] U.S. Cl. ..... 454/296; 454/299

[58] Field of Search ..... 454/297, 296, 454/299, 280, 316

[56] References Cited

U.S. PATENT DOCUMENTS

| | | | |
|---|---|---|---|
| 2,982,197 | 5/1961 | Roberts . | |
| 3,021,778 | 2/1962 | Slatkovski | 454/280 |
| 3,948,155 | 4/1976 | Hedrick . | |
| 4,020,752 | 5/1977 | Stephan . | |
| 4,073,597 | 2/1978 | Barnhart et al. . | |
| 4,815,934 | 3/1989 | Rademaker | 454/297 |
| 4,991,496 | 2/1991 | Kuno et al. | 454/299 |
| 5,318,474 | 6/1994 | Klassen et al. . | |

OTHER PUBLICATIONS

Submittal Drawing Form No. 107 of J&J Register Co., Inc. (1984).

Catalog Sheet Nos. G97, G98, G99 (all from 1997 catalog) and Nos. G84 and G85 from 1998 catalog of Titus.

1992 catalog of Metal*Aire entitled "Mod–Flo Modular Adjustable Air Diffusers".

*Primary Examiner*—Harold Joyce
*Assistant Examiner*—Andrea M. Joyce
*Attorney, Agent, or Firm*—Ridout & Maybee

[57] ABSTRACT

Modular ceiling air diffusers are provided in which the core deflector elements are pre-fabricated in a one-hit one-part pressing operation to form a selected pattern of integral louvers shaped to deflect air in a desired horizontal air pattern. This reduces the labor content and material costs in manufacturing modular ceiling air diffusers compared to prior art devices of this kind, without compromising the level of air distribution performance.

7 Claims, 7 Drawing Sheets

MODULAR CORE AIR DIFFUSERS

BACKGROUND OF THE INVENTION

The present invention relates to air diffusers, more particularly to modular air diffusers for ceiling-mounted air distribution systems.

A known form of air diffuser system comprises a coplanar series of movable circulation blades, each pivoted about a single axis. By this arrangement, variations in flow direction relative to that axis can be obtained.

Particularly for air diffusers of the kind commonly found in ceiling installations, it is desirable to have the flexibility of introducing air into a room in a one, two, three or four way air stream along the ceiling.

With a view to providing a diffuser assembly capable of being switched from one to another air distribution pattern, a number of "modular" air diffusers have been developed, containing a fixed framework within which individual deflector elements can be retained and shifted about, to afford a variety of orientations. An air diffuser of this kind is disclosed, for example, in U.S. Pat. No. 4,020,752 issued May 03, 1977 to Stephan. Four square modular core elements are removably retained within a rectangular framework. Each such element includes a plurality of blades with their free ends pivotably mounted along respective opposite sides of the square core element.

However, modular diffusers having core elements with movable circulation blades are labor-intensive to manufacture and, despite their flexibility in altering air distribution patterns from an air diffusion unit, have not proved to be competitive with non-modular systems.

SUMMARY OF THE INVENTION

It is a principal object of my invention to reduce labour content and material costs in the manufacture of a modular ceiling air diffuser compared to prior art devices of this kind, while affording a high level of air distribution performance by promoting a uniform air flow pattern and minimizing noise.

With a view to achieving these objectives and avoiding the disadvantages of the prior art, modular core air diffusers according to the present invention include an air deflector assembly which is prefabricated in one piece of coil stock (steel or aluminum) in a one-hit one-part punch-and-die pressing operation. The air deflector assembly is thereby formed with a selected pattern of integral louvers shaped to deflect air in a desired horizontal air pattern.

According to a particular embodiment of the invention, the air deflector assembly comprises a plurality of modular deflector core sub-assemblies, each produced in a one-hit one-part pressing operation as aforesaid and a frame for removable and adjustable insertion of the core sub-assemblies therein, permitting selective adjustment of the air pattern.

Some preferred embodiments of the invention will be described, by way of example only, with reference to the accompanying drawings.

DESCRIPTION OF ILLUSTRATED EMBODIMENTS

A fundamental difference between ceiling diffusers according to the present invention and known modular core ceiling diffusers resides in the functional simplicity of the air deflector assembly of the diffuser core.

According to my invention, the blades of the louvered air deflector element are formed integrally with the body of that element.

In "fixed core" modular core diffusers according to the present invention, the air deflector assembly is a single assembly of die-cut louvers which may be formed integrally with the backpan of a diffuser assembly, or else as a separate deflector "patch" element to be positioned and removably secured, in use, over a central inlet through the backpan.

The aforementioned first variant of fixed core diffuser is exemplified by the "PDFC" diffuser discussed below in relation to FIGS. 1 and 2. The aforementioned second type of fixed core diffuser is exemplified by the "PDSP" diffuser described in relation to FIGS. 3 and 4.

Figure 5:
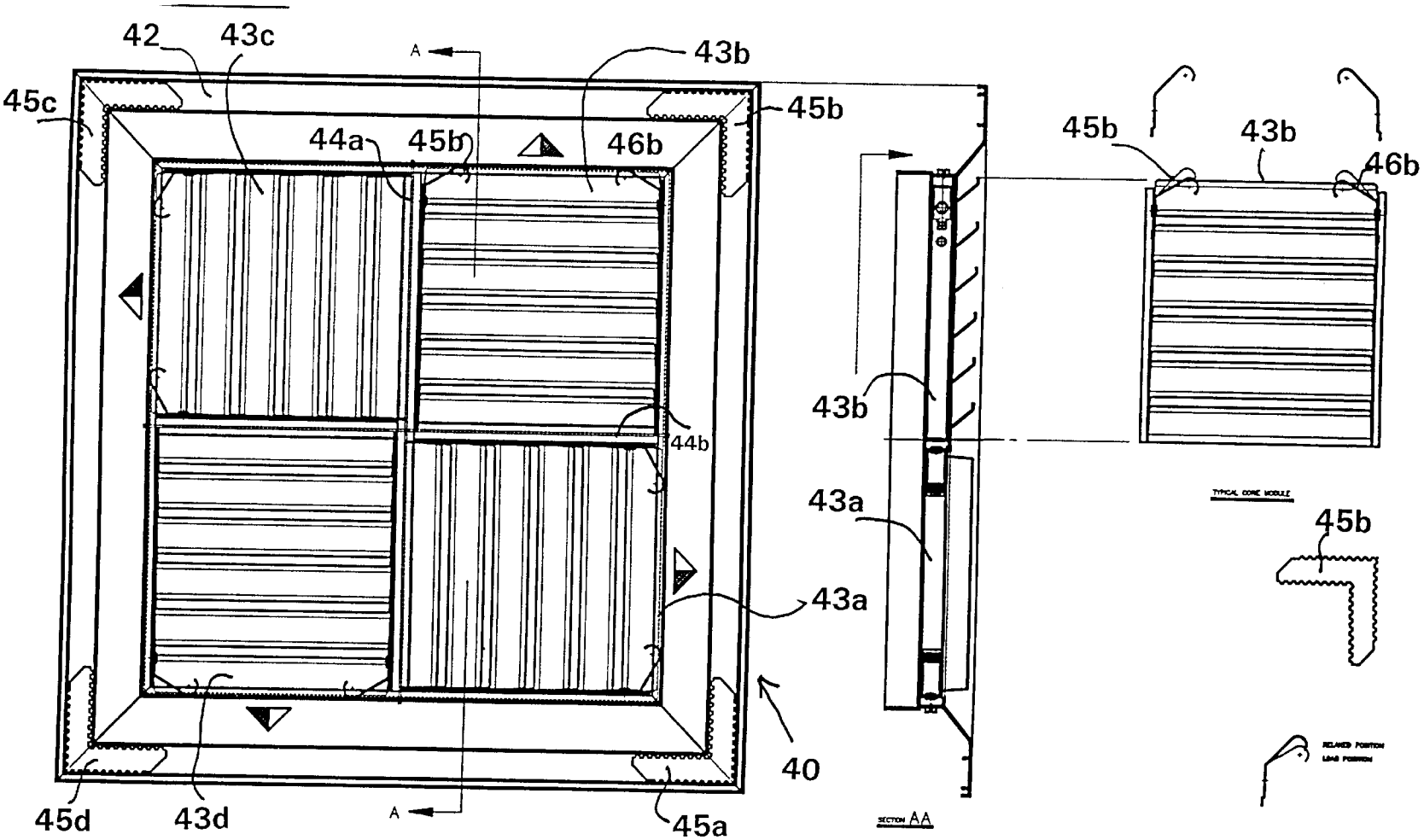
FIG. 5 provides a top plan view and cross-sectional details of an assembled air diffuser according to a third embodiment of the invention, in which a plurality of modular deflector core elements are adjustably laid out in a holding frame.
Figure 6:
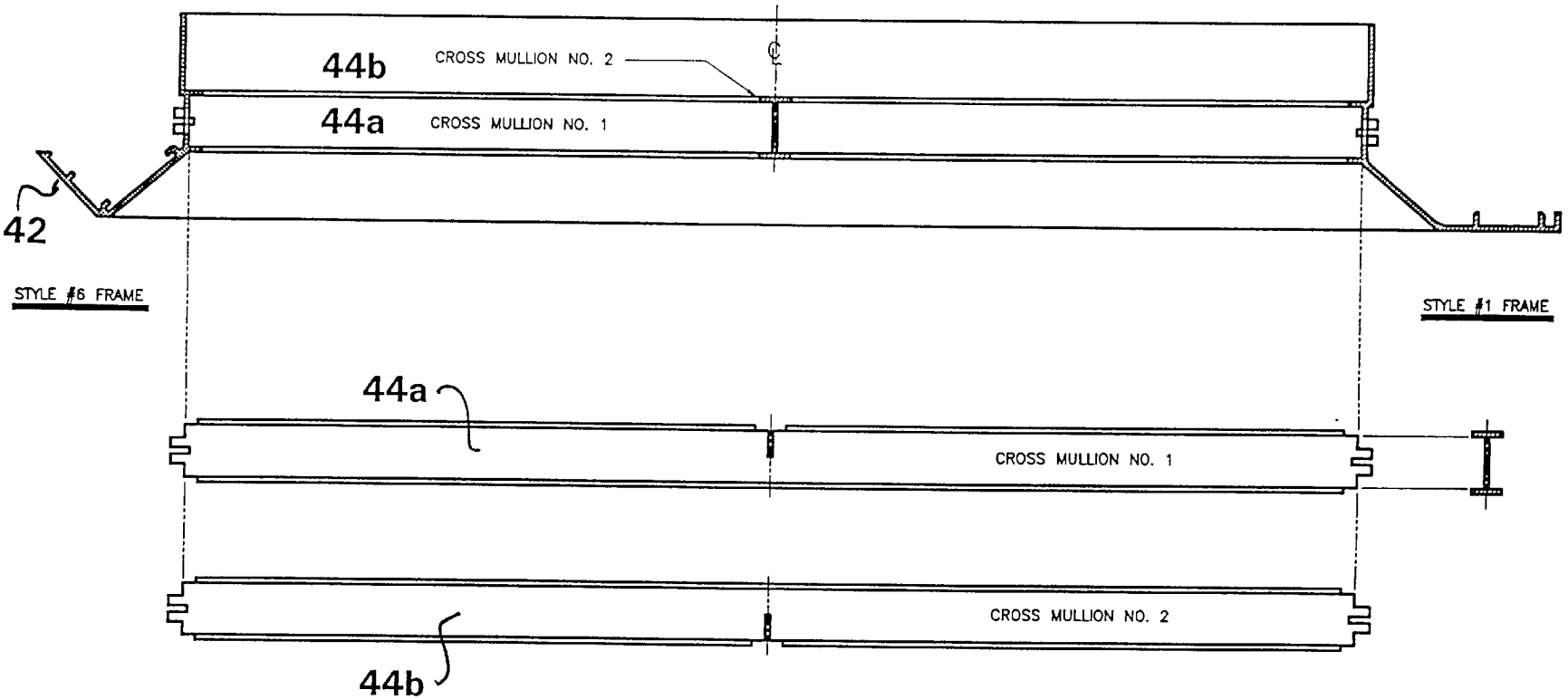
FIG. 6 shows details of cross-mullion supports and frame members in the frame sub-assembly of the air diffuser of FIG. 5.
Figure 7:
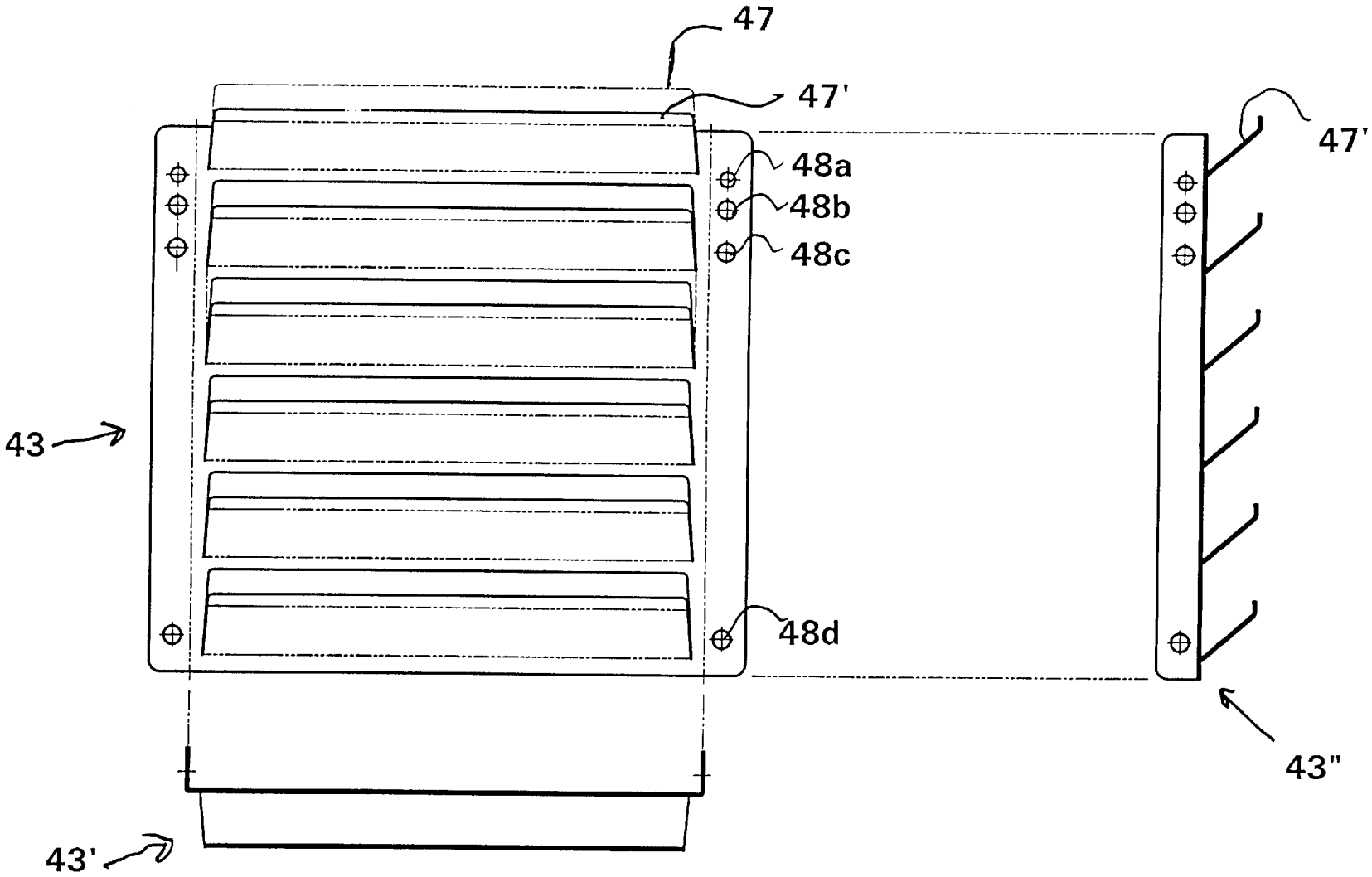
FIG. 7 shows a blank layout and forming stages of a one-piece core element of the air diffuser of FIG. 5.

In "adjustable core" modular core diffusers according to the present invention, exemplified by the "SMCD" or "AMCD" diffuser described relative to FIGS. 5 to 7, the air deflector assembly comprises a plurality of modular core elements. These are provided with spring or like means whereby the modular core elements may be releasably fitted into a core frame in various orientations, to selectively achieve a one-way, two-way corner or three-way air discharge pattern.

Figure 1:
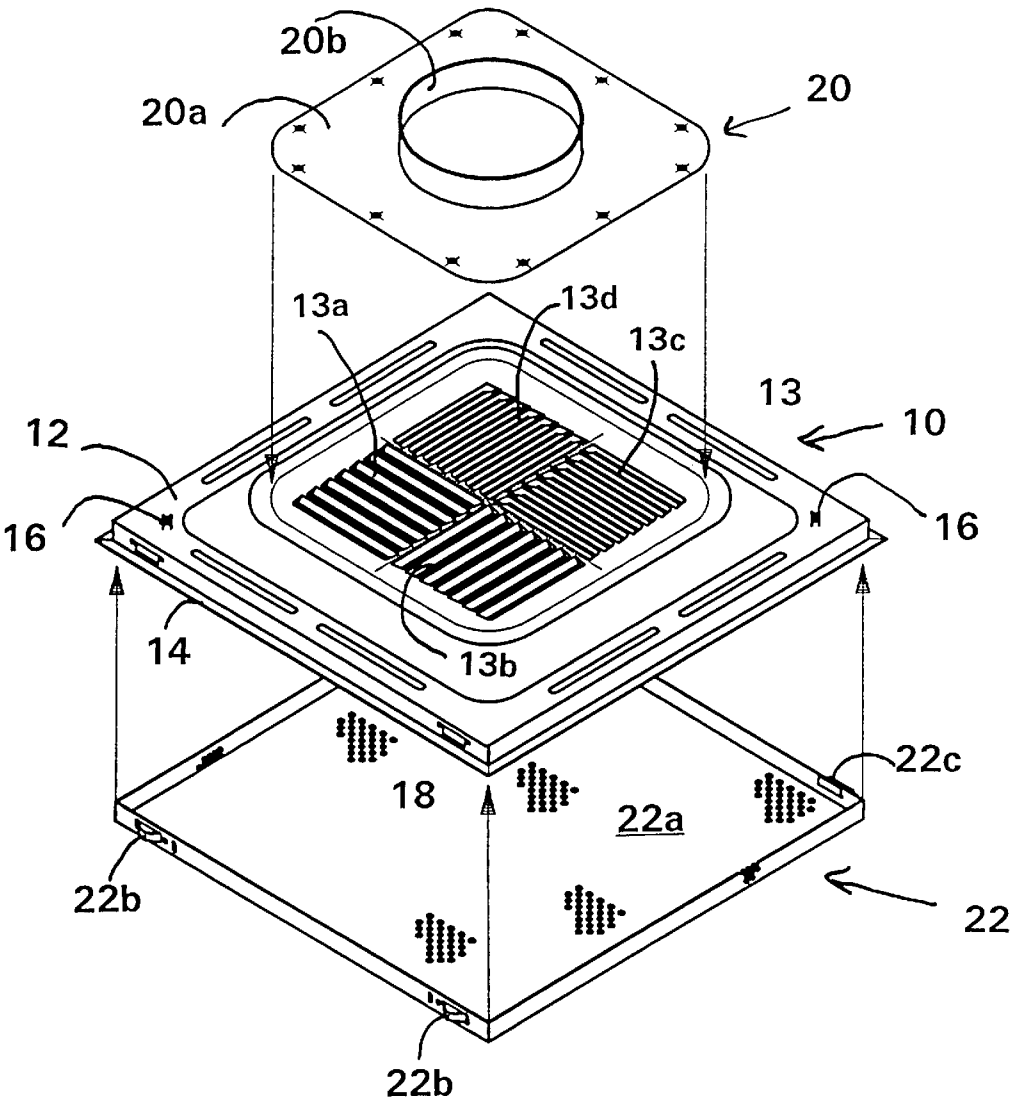
FIG. 1 is an exploded perspective view of a first embodiment of a diffuser according to the present invention, illustrating the sequence of assembly of the principal components.
Figure 2:
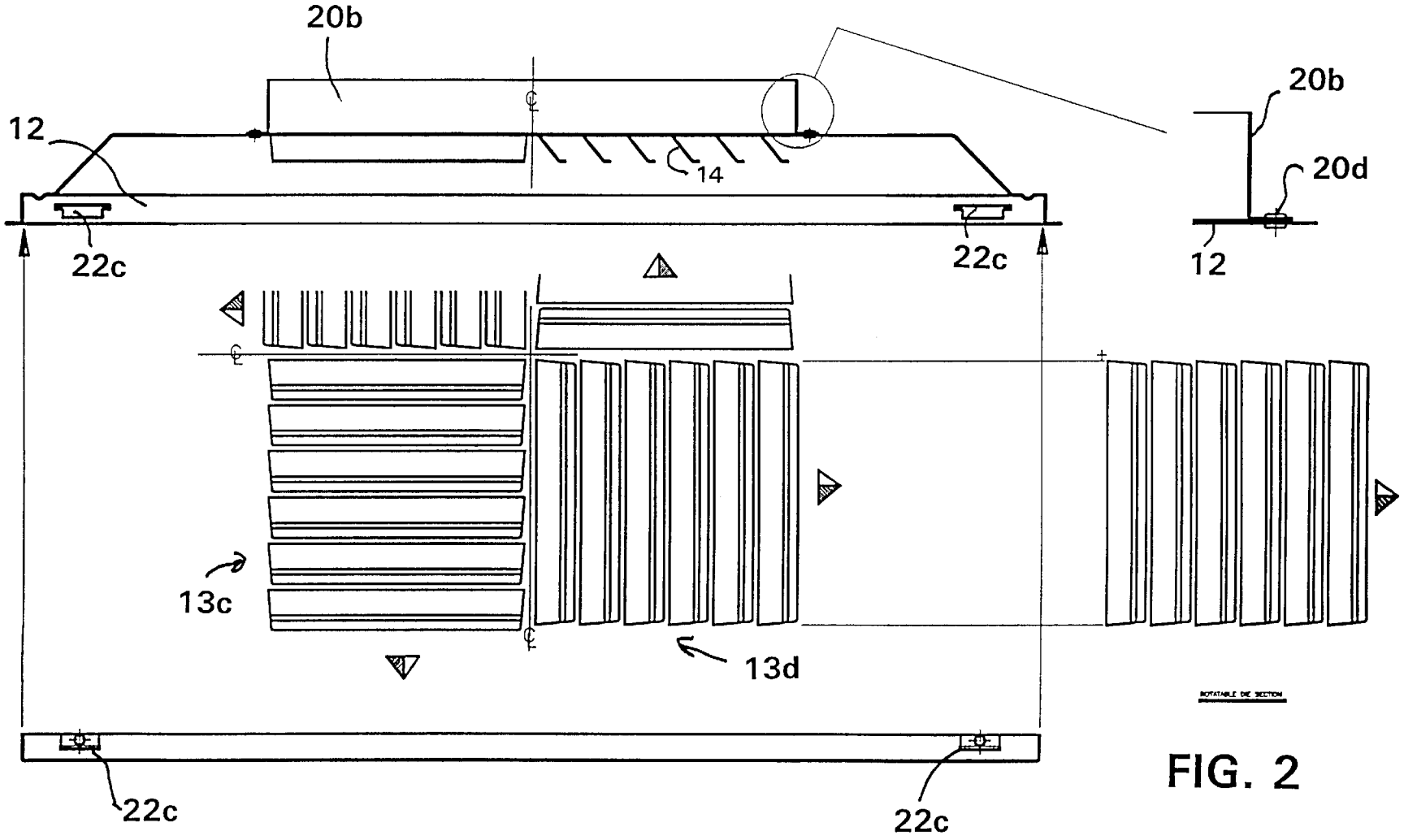
FIG. 2 is an enlarged cross-sectional view of the embodiment of FIG. 1, showing details of the deflector element.

(i) Perforated-face Diffuser, Fixed Core (PDFC) —FIGS. 1 and 2

The air deflector element in this arrangement is an integral diffuser backpan/core module indicated generally at 10. Backpan portion 12 and the central core portion 13 with louvered integral core modules 13*a*, 13*b*, 13*c* and 13*d* are formed in a single piece, by feeding steel or aluminum coil stock into a three-station mechanical press. In a one-hit/one-part operation using a progressive die, there are carried out the three stages of (i) blanking, (ii) forming the backpan 12; and (iii) lancing defector blades 14 and forming the integral core modules 13*a*–13*d* into the desired louver patterns.

FIGS. 1 and 2 show a four-way pattern, but by means of quick-change die sections, the pressing operations may be modified to produce a unibody backpan/diffuser core with any of the other louvered patterns commonly used for air distribution, e.g., one-way, two-way, three-way and two-way corner. Other features which may be formed into the backpan/diffuser core 10 in the pressing operation, for the purpose of subsequent assembly in the PDFC, are stiffening ribs 14, seismic loops 16 and slots 18 to receive locking springs or hinged latches.

Air inlet means connectable to the air supply duct of a room air distribution system comprises, for the embodiment illustrated, a neck inlet patch 20, with an aluminum or steel square metal patch portion 20*a* and an integral die-formed inlet collar 20*b* to direct inlet air through the central core portion 13 of the backpan/core module 10. Patch 20*a* may conveniently be provided with pre-punched mounting holes 20*c* to accommodate pop-inserts 20*d* or sheet metal screws for fastening the patch to backpan 12.

In commercial buildings, it is usually desirable to provide the room-side face of the diffuser core with a flat perforated plate. The diffuser of FIGS. 1 and 2 is provided with a perforated hinge-down screen 22, including a perforated grille surface, 22*a* and suitable means for attachment to backpan 12, such as leaf springs 22*b* and hinge latches 22*c* mateable with corresponding slots 18 in edge surfaces of the backpan.

Screen 22 may be simply made by feeding aluminum or steel coil stock through a two-stage mechanical press. To install the perforated screen, one simply engages hinge latches 22*c* with slots 18 in backpan 12, and lifts the opposite end of screen 22 into the backpan, compressing and releasing leaf spring 22*b* so that they snap into corresponding backpan slots 18. Hinging-down of screen 22 can readily be effected by using a flat object (such as a plastic credit card), inserted from the face of the diffuser into the gap between the vertical perimeter wall of backpan 12 and the upright flange of screen 22. Moving the flat object towards the corners dis-engages leaf springs 22*b* from corresponding slots 18 in backpan 12, so releasing the flat perforated pan 22 for hinging down.

FIG. 2 provides cross-sectional detailed views of the PDFC components, in particular the lanced-in deflector vanes (blades) 14 of the core portion 13. I have found that for best air performance, the acute angle between each of the louver vanes 14 and the horizontal plane of the core 13 should be in the range of 45° to 60°, preferably around 50°. This results in an air pattern that spreads out horizontally as close to the ceiling of the room as possible. It further reduces the static pressure and noise levels.

Figure 3:
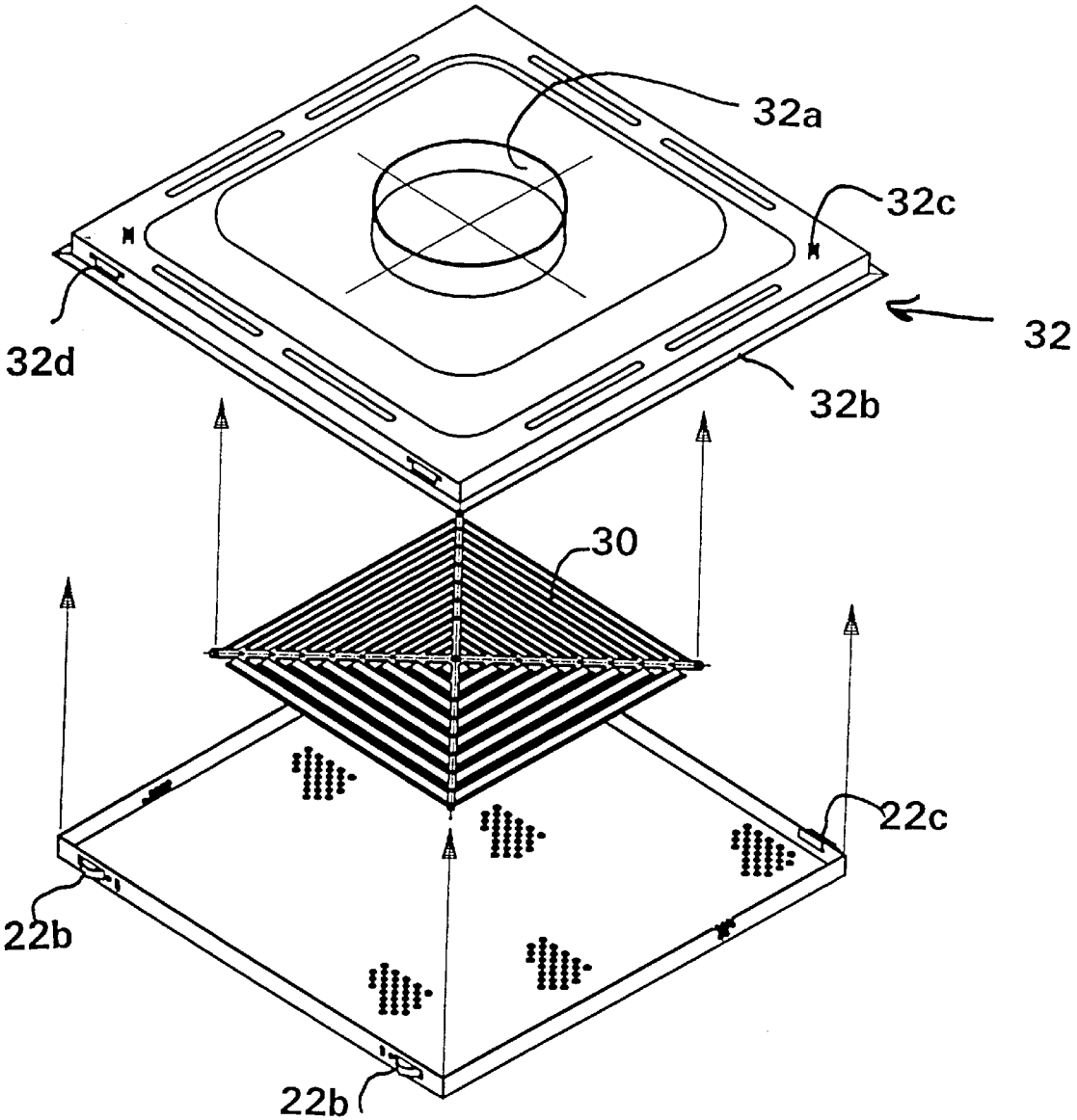
FIG. 3 is an exploded perspective view of a second embodiment of diffuser according to the present invention, illustrating the sequence of assembly of the principal components.
Figure 4:
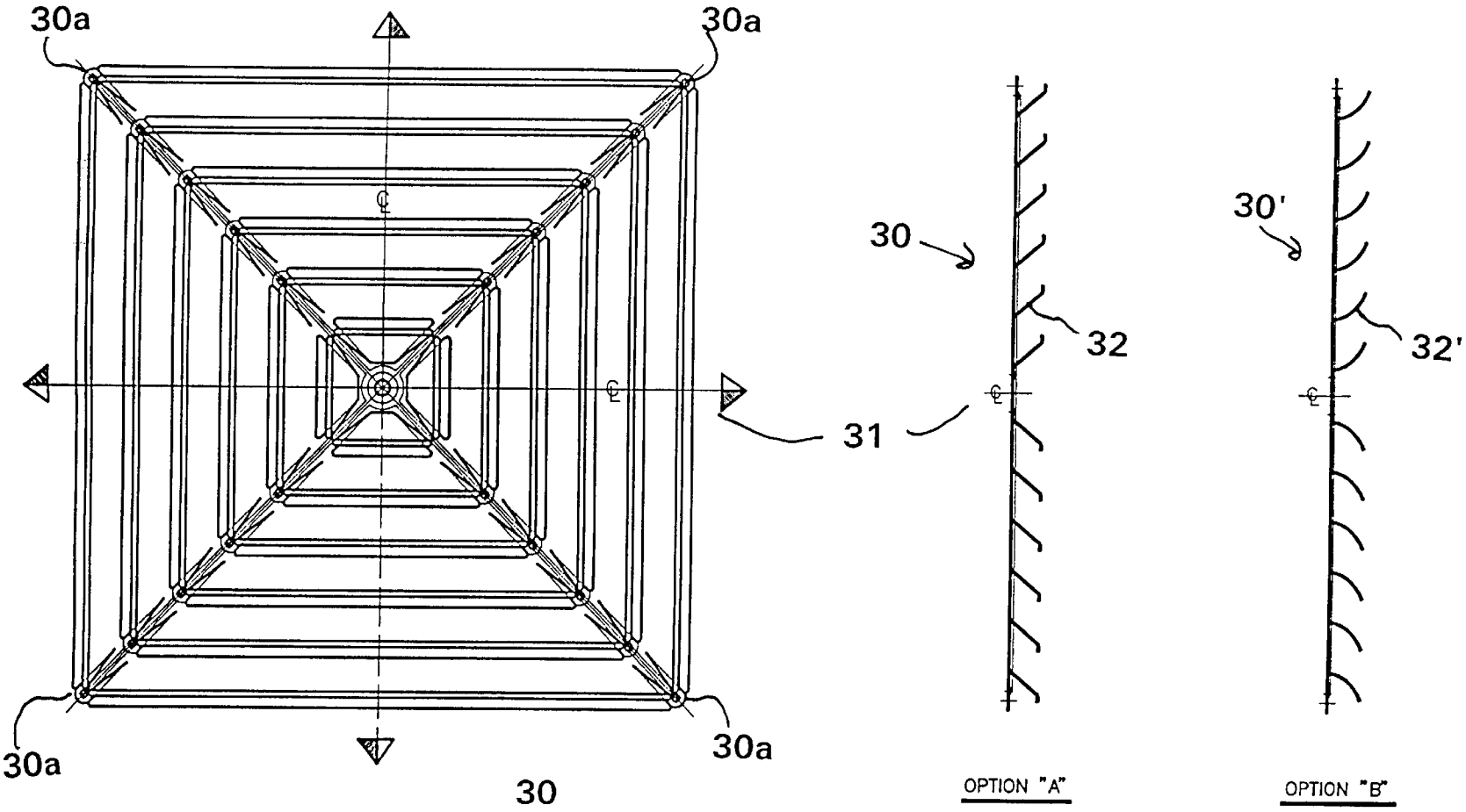
FIG. 4 is an enlarged plan view and sectional view of the louvered air deflection element of the diffuser of FIG. 3, illustrating two optional configurations of integrally formed air deflector blades.

(ii) Perforated-face Diffuser, Star Pattern (PDSP) —FIGS. 3 and 4

In this arrangement, the air deflector element is a "core patch" separate from the backpan, and is indicated at 30 in FIGS. 3 and 4.

In use, core patch 30 is secured by rivets or screws, through pre-punched mating holes 30*a*, to the underside of a standard diffuser backpan 32 having an integral neck inlet 32*a* connectable to the room air supply duct.

The backpan 32 is made from steel feed coil stock in a one-hit/one-part pressing operation using a two-station mechanical press and quick-change die sections to form the neck inlet 32, or using a progressive die in a hydraulic press. As in the case of the backpan/diffuser core component of the PDFC air diffuser, stiffening ribs (32*b*) seismic loops (32*c*) and slots (30*d*) for receiving leaf springs or hinged latches may be formed in backpan 32 in the press-forming operation.

The core patch 30 is made by feeding steel or aluminum coil stock through a multi-stage mechanical press or through a progressive die in a hydraulic press in a one-hit/one-part complete operation. The lanced pattern of louvers can be formed in any of the earlier described useful configurations, i.e., one-way, two-way, etc., but the "star pattern" of the illustrated air pattern patch 30 has the useful feature of being rotatable about its central axis 31, to allow the resulting air distribution pattern to be changed. For example, patch 30 could be attached in a square or in a diagonal orientation relative to the neck inlet underside of diffuser backpan 20.

An alternative configuration for the air pattern core patch 30 in this embodiment of the invention would be a radio layout air discharge pattern, in which deflector vanes are pressed (lanced) in a semi-circular formation instead of the star pattern described above.

In this embodiment, there is again provided, at the bottom face of the diffuser, a perforated hinge-down screen 22' with perforated grille surface 22'*a* and attachment means mateable to the slot 32*d* of backpan 32, namely leaf springs 22'*b* and hinge latches 22'*c*.

FIG. 4 shows cross-sectional details of the core patch 30 or an alternative star-pattern patch 30' with a different shape of deflector vane formed into the patch. Vanes 32 of patch 30 are the parallel, planar louvers already described, while the patch 30', the individual vanes 32' are convexly curved toward the air flow from the inlet duct, that is, toward the acute angle of inclination of each vane. In both variations, the vanes are regularly spaced apart, typically at about one-inch intervals, and have an average inclination to the horizontal which is from 45° to 60°, preferably above 50°.

(i) Adjustable Modular Core Diffusers —FIGS. 5 to 7

In this arrangement, a modular core assembly 40 including a small adaptor frame 42 is screw-mounted or otherwise removably attached to the underside of the inlet of a conventional diffuser backpan (not shown), e.g., like backpan 32 of the PDSP diffuser described above.

Modular core assembly 40 comprises an aluminum (AMCD) or steel (SMCD) core frame 42, which includes recesses and locking means for releasably receiving a plurality of pre-assembled modular core elements 43*a*, 43*b*, 43*c* and 43*d*.

As an example of a simple procedure for assembling frame 42, four mitre-cut steel or extruded aluminum frame sections, centrally punched to create slots for cross-mullions 44*a* and 44*b*, are joined in two "L" formations and the respective corners secured. In the case of steel frames, the L junctions may be projection welded at the mitred corners using a corner dutchman (45*a*–45*d*). Alternatively, the junctions may be secured by spot-welding.

As best seen in FIG. 6 showing common cross mullion supports, frame and mullion details for the SMCD or AMCD, the pre-fabricated universal cross-mullions 44*a* and 44*b* are interlocked like the cross-members of an egg crate. The ends of mullions 44*a* and 44*b* are inserted into the center slots of the aforementioned pre-assembled, "L" formation pairs of outer frame members, and two "L" formation frames are joined as previously described to lock the cross-mullions in and so complete the frame sub-assembly 42 of the modular core assembly 40.

Each of the modular core elements 43*a*–43*d* is fitted with a pair of leaf springs (45*a*/46*a*, 45*b*/46*b*, 45*c*/46*c*, and 45*d*/46*d*) which are compressed when inserting that element into one of the four square regress portions of the frame/mullion openings.

Each of the modular core elements 43 is prefabricated from a single piece, as is characteristic of all louvered core elements in diffusers according to the present invention. FIG. 7 illustrates a typical blank layout of a one-piece core element 43, in which lines 47 and 47' respectively denote the line of demarcation of one of the deflector vanes (i) in the blank and (ii) in the formed blade. Holes 48*a*–48*d* are prepunched into the blank 43 to accommodate spring clips in the fully formed core element, and as paint holes to facilitate paint-line hanging of core elements.

View 43' of the individual core element is a right-angled view of a fully formed one-piece core element and view 43" is a cross-sectional view of the fully formed one-piece core element showing the fully formed deflector blades 47' produced in the lancing stage of pressing.

In this embodiment of diffuser, it is usual to omit the perforated face screen, thereby exposing individual core modules for easy access and job-site rotation. Individual core modules within the sub-assembly allow for quick field job-site rotation, so that a four-way air pattern as shown in the drawings can be easily converted to a one-way, two-way, two-way corner or three-way air pattern.

Applicant's novel approach to the manufacturing process for diffuser cores, through the functionally simple expedient of pressing the contoured air deflector vanes directly into the element affords a number of advantages over prior art ceiling diffusers, including the following:

core modules may readily be made in a number of sizes and matched to the required air volumes of round or square neck inlet sizes on existing air distribution systems.

installation of modular core ceiling diffusers according to the present invention can readily be integrated with most architectural ceiling suspension systems.

the pattern of louvers in each modular element is selected to produce strong horizontal air patterns, resulting in entrainment and mixing of ambient room air for maximum comfort level, eliminating drafts (hot and cold zones).

Several embodiments of the invention have been illustrated, but it will be understood by those of ordinary skill in the art that other modifications and alterations could be made without departing from the spirit and scope of the invention.

I claim:

1. An air diffuser for distributing air from an air supply duct of an air distribution system into a room, comprising:

(a) air inlet means connectable to said air supply duct;

(b) a framework having a central portion affording passage of air from said air inlet means through one side of the framework to the other side of the framework into the room; and (c) at least one core diffuser element of a one-piece sheet metal construction presenting a pattern of louvers therethrough for deflecting air passing through said central portion of the framework in a desired distribution pattern, said framework is a conventional air diffuser backpan having a central opening with integral tubular air inlet means extending at said one side of the framework.

2. An air diffuser according to claim 1, wherein said louvers comprise planar deflector vanes inclined to the horizontal plane of said at least one core diffuser element at an angle between 45° and 60°.

3. An air diffuser according to claim 1, wherein said at least one core diffuser element is integrally formed with said framework, as said central portion thereof.

4. An air diffuser according to claim 1, wherein said air inlet means comprises a plate securable over said one side of the framework with a central opening therethrough into an integral tubular section for connection to said air supply duct.

5. An air diffuser according to claim 1, wherein said at least one core diffuser element is rotatably secured over said central opening of the backpan across said other side thereof.

6. An air diffuser according to claim 5, wherein said desired pattern of louvers comprises a plurality of planar louvers extending radially across said one-piece sheet metal construction, each of said planar louvers being inclined at an angle of between 45° and 60° to the horizontal plane of said core diffuser element.

7. An air diffuser according to claim 1, wherein said framework is divided by cross pieces into a plurality of rectangular openings, and an integral rectangular core diffuser element is releasably fitted into each of said openings.

* * * * *